US010634406B2

(12) United States Patent
Langheinz

(10) Patent No.: US 10,634,406 B2
(45) **Date of Patent: *Apr. 28, 2020**

(54) BINARY-ICE PRODUCTION DEVICE AND METHOD THEREFOR

(71) Applicant: Hubert Langheinz Kältetechnik, Starzach (DE)

(72) Inventor: Hubert Langheinz, Starzach (DE)

(73) Assignee: Hubert Langheinz Kältetechnik, Starzach (DE)

( * ) Notice: Subject to any disclaimer, the term of this patent is extended or adjusted under 35 U.S.C. 154(b) by 187 days.

This patent is subject to a terminal disclaimer.

(21) Appl. No.: 15/038,252

(22) PCT Filed: Nov. 19, 2014

(86) PCT No.: PCT/DE2014/100406

§ 371 (c)(1),
(2) Date: Sep. 20, 2016

(87) PCT Pub. No.: WO2015/074643

PCT Pub. Date: May 28, 2015

(65) Prior Publication Data

US 2016/0377336 A1 Dec. 29, 2016

(30) Foreign Application Priority Data

Nov. 20, 2013 (DE) ..... 10 2013 112 829

(51) Int. Cl.
*F25C 1/08* (2006.01)
*F25C 1/147* (2018.01)

(52) U.S. Cl.
CPC ..... *F25C 1/08* (2013.01); *F25C 1/147* (2013.01); *F25C 2301/002* (2013.01)

(58) Field of Classification Search
CPC ..... F25C 1/08; F25C 1/147; F25C 2301/002; F25C 2500/08; A23G 9/045; A23G 9/222
See application file for complete search history.

(56) References Cited

U.S. PATENT DOCUMENTS 4,438,634 A * 3/1984 Merle ..... F25C 1/147 366/168.1
6,830,239 B1 12/2004 Weber et al.
(Continued)

FOREIGN PATENT DOCUMENTS

CA 2 387 219 A1 11/1999
DE 34 86 374 T2 11/1995
(Continued)

OTHER PUBLICATIONS

International Search Report for corresponding International Application No. PCT/DE2014/100406 dated Jul. 2, 2015.

*Primary Examiner* — Christopher R Zerphey
(74) *Attorney, Agent, or Firm* — Renner, Otto, Boisselle & Sklar, LLP

(57) ABSTRACT

A method for continuously producing a flowable, pumpable, cooled mass or cooling mass, in particular for use as foodstuffs and food products and/or for foodstuffs and food products made of a flowable base mass, including the following steps: filling a housing with the flowable base mass; cooling the flowable base mass by bringing it in contact with a heat exchanger device disposed in the housing while stirring the base mass so as to generate the pumpable, cooled mass or cooling mass, wherein, when a layer, and in particular an ice layer, forms on the heat exchanger device, cooling is interrupted as soon as the layer, and in particular the ice layer, reaches a predetermined thickness, and cooling is continued as soon as the layer drops below the predetermined thickness, wherein the base mass and/or the mass is moved radially outwardly along the heat exchanger surfaces
(Continued)

during stirring, and a force is transmitted for stirring from outside the housing to the inside, without contact and without apertures through the housing. The invention further relates to an air conditioning method, to a cooling mass production device, to an energy system, and to a use therefor.

6 Claims, 14 Drawing Sheets

(56) References Cited

U.S. PATENT DOCUMENTS

| | | | | |
|---|---|---|---|---|
| 7,296,425 | B2 * | 11/2007 | Goldstein | A23G 9/228 62/135 |
| 9,784,459 | B2 * | 10/2017 | Langheinz | F25C 1/12 |
| 2001/0035016 | A1 | 11/2001 | Weber et al. | |
| 2003/0080644 | A1 * | 5/2003 | Nelson | A23G 9/045 310/196 |
| 2004/0187518 | A1 * | 9/2004 | Laude Bousquet | F25C 1/08 62/434 |

FOREIGN PATENT DOCUMENTS

| | | | |
|---|---|---|---|
| EP | 0 168 537 | A2 | 1/1986 |
| EP | 1 477 455 | A1 | 11/2004 |

* cited by examiner

BINARY-ICE PRODUCTION DEVICE AND METHOD THEREFOR

TECHNICAL FIELD

The invention relates to a method for producing a flowable, pumpable, temperature-controlled, and in particular cooled, mass or cooling mass made of a flowable base mass.

The invention further relates to a method for air conditioning rooms, in which heat is stored in a latent heat storage system.

The invention also relates to a cooling mass production device for producing a flowable, pumpable cooled mass or cooling mass from a flowable base mass.

The invention furthermore relates to an energy system, and in particular to an air conditioning system for air conditioning rooms or for heating process water, as an energy source for heat pump systems, in which energy and/or heat is stored in a latent heat storage system and/or withdrawn therefrom.

And finally the invention relates to a use of flowable, pumpable cooling mass.

DESCRIPTION OF THE RELATED ART

Ice slurry, methods and devices for the production thereof are generally known. Ice slurry is also referred to as ice slush, slurry, slush ice, slurry ice, pumpable ice, liquid ice and the like.

An ice making machine is known from DE 34 86 374 T2, comprising: a housing having an inlet for receiving a liquid in the form of an aqueous solution having a concentration that is below the eutectic concentration thereof, from which the ice is to be made; an outlet to allow ice to egress from the housing; a heat exchanger in the housing, having a coolant inlet and a coolant outlet to allow a flow of coolants for the purpose of extracting heat from the liquid, and at least one heat exchanger surface, which separates the coolant from the liquid; a scraper, which is disposed in the housing so as to be movable about an axis, wherein the scraper and the aforementioned respective heat exchanger surface extend transversely to the aforementioned axis; means for receiving an amount of liquid in the housing so as to substantially fill the housing and cover the respective heat exchanger surface, wherein the scraper is in contact with the respective heat exchanger surface and can be moved about the axis so as to scour the respective heat exchanger surface, the ice making machine further comprising: a drive, which drives the scraper and moves the same across the aforementioned heat exchanger surface at such a speed that the scraper scours the respective heat exchanger surface during consecutive revolutions over the same so as to scrape off a cooled layer of the liquid from the respective heat exchanger surface before the ice crystallizes thereon, wherein the scraper supplies liquid from the respective heat exchanger surface to the amount of liquid in the housing so as to maintain a substantially uniform temperature there.

Therefore, it is an object of the present invention to create a method and a cooling mass production device in which a flowable base mass is generated more homogeneously and efficiently and for multiple usage purposes. Moreover, it is an object to use the cooling mass, or the method and the device for the production thereof, for an air conditioning or energy system using ice slurry as a latent energy storage system.

SUMMARY OF THE INVENTION

The invention encompasses the technical teaching that, in a method for producing a flowable, pumpable, temperature-controlled, and in particular cooled, mass or cooling mass, in particular for use as foodstuffs and food products and/or for foodstuffs and food products made of a flowable base mass, comprising the following steps: filling a housing with the flowable base mass; controlling the temperature of, and in particular cooling, the flowable base mass, or the cooling mass that has already been produced, by bringing it in contact with a heat exchanger device, or, in more general terms, with a heating and/or cooling device, disposed in the housing, while stirring, in particular continuously stirring, the base mass so as to generate the cooling mass, it is provided that, when a layer, and in particular an ice layer, forms on the heat exchanger device, temperature-controlling, and in particular cooling, is interrupted as soon as the layer, and in particular the ice layer, reaches a predetermined thickness, and that temperature-controlling or cooling is continued as soon as the layer, and in particular the ice layer, drops below the predetermined thickness. The base mass is any arbitrary flowable or pumpable mass. The base mass can be liquid, viscous, paste-like, puree-like or the like. The base mass is preferably a mixture or blend made of a base fluid or a base liquid and one or more additions. In one embodiment, the addition is (or the additions are) soluble in the base fluid. The base mass is preferably a fluid slurry, such as an ice slurry brine. In one embodiment, the base mass is a puree, such as apple sauce, a preserve or the like. The base mass is suitable for use as a foodstuff, food product and/or as an addition thereto. In another embodiment, the base mass is an ice slurry brine. In still another embodiment, the base mass is a water/sugar solution. In still another embodiment, the base mass is a water/salt/sugar solution or another composition. The base fluid has a defined or sliding melting and/or freezing point. The addition is designed so as to change the melting point and/or the freezing point, and in particular such that the melting point and/or the freezing point is lowered. Controlling the temperature can comprise cooling, heating, or both. The concentration of the addition in the base fluid can be arbitrarily set up to saturation of the addition in the base fluid. In one embodiment, the base mass is cooled to or below the freezing point of the base fluid. The addition does not cause the base mass to freeze. The base mass is cooled appropriately so that, in one embodiment, the base mass can be used as cooling mass that remains pumpable. The cooling mass can be used in particular for cooling and for admixing the addition and/or the base fluid in further food-processing processes, such as in meat production, dough production, bread making, the production of confectionaries, and in particular pastries, and the like. The method can be used in particular for process cooling during the production of foodstuffs and food products. The base fluid is preferably water, and in particular food-safe water, which is to say water that can be used for foodstuff production. The addition is preferably a food-safe addition, which is to say an addition that can be used for foodstuff production. Milk is another base fluid. Juice or the like is still another base fluid. The cooling mass is produced from a liquid base mass. For this purpose, a base fluid having a predetermined percentage of an addition is produced. The base mass is an ice slurry brine, for example. Correspondingly, the base fluid is water, and the addition is salt. In another preferred embodiment, the base fluid is water, and the addition is sugar. The base mass, for example in the form of an ice slurry brine, preferably comprises water, for example tap water, and a salt, for example common salt, NaCl, or sugar or the like in the case of pastry production, as constituents. The base mass, for example the ice slurry brine, is preferably mixed as an approximately 0.01 to 20% base mass or ice slurry brine, preferably as an approximately 0.5 to 4.5% base mass or ice slurry brine, and most preferably as an approximately 1.0 to 3.5% base mass or ice slurry brine. The same applies to a sugar water solution. So as to provide a desired base mass having an appropriate mixing ratio, a saturated base mass solution, for example a saline solution or a sugar water solution of the unsaturated base mass solution or of the base fluid, for example of the unsaturated ice slurry solution or the sugar water solution, is provided or admixed. For example, when using NaCl and $H_2O$ as the ice slurry brine, a saturated solution of NaCl+$H_2O$ is provided or mixed in one step. Moreover, separately from this, a further ice slurry brine is provided. In the further ice slurry brine, first a desired solution ratio of NaCl to $H_2O$ is detected. If the sodium chloride (NaCl) content, or the salt content in general, of the solution is too high, $H_2O$ is added. If the $H_2O$ content of the solution is too high, some of the saturated ice slurry brine is added to the further ice slurry brine. The same applies analogously to the sugar water solution or, more generally speaking, to the base mass or a mixture of a sugar solution and a salt solution. The above-described level regulation is preferably controlled automatically or via a regulating loop. In this process, a desired concentration value is established. The concentration value is ascertained. If a desired concentration value is exceeded or no longer met, a desired constituent is added, for example from the saturated solution or an unsaturated solution and/or a solution having a low concentration. When a desired concentration value is reached, the base mass, for example the ice slurry brine or the sugar water, is added to a container, or mixed directly in the container in which the cooling takes place. The container preferably has a cylindrical design; in another mode it has a conical design. The container is preferably insulated in keeping with the temperature of the medium and the ambient temperature so as to prevent transmission heat losses and dropping below the dew point. In another embodiment, the container has a double-walled design so as to create an additional heat exchanger surface on the inside wall. The container is preferably designed as a cooling container; in another embodiment, it is designed as a heating container, or as a cooling and heating container. In one step, the base mass, for example the ice slurry brine or the sugar water, is pre-cooled before being added to the container. Adding is preferably carried out in a controlled manner, in particular controlled as a function of a fill level of the container. The adding is preferably controlled in such a way that a desired fill level is adhered to. As soon as the base mass, for example the ice slurry brine or the sugar water, having the desired concentration ratio is added to the container, and the same thus makes contact with the heat exchanger located there at the appropriate heat exchanger surfaces, the process of cooling the base mass commences. Cooling takes place in a controlled manner, for example in a temperature-controlled manner, a time-controlled manner, an energy-controlled manner, an ice thickness-controlled manner, or the like. Cooling preferably takes place while continuously stirring the base mass. In this way, thorough mixing of the base mass is achieved from the outset. Over the course of the process of cooling the base mass, cooling down to the range of the freezing point of the base fluid or of the base mass causes crystals to form, and causes a partial change in the state of matter to occur, and thus causes an ice layer to form at the heat exchanger surfaces.

However, other forms of layer formation such as adhering, gluing or the like also result in a layer formation. Since stirring takes place without contact with the heat exchanger surfaces, stirring is initially not blocked by the layer, and in particular the ice layer. However, stirring also takes place in close proximity to the heat exchanger surfaces. Here, a distance between a stirring surface of a stirring element and a heat exchanger surface is selected in such a way that stirring cannot be blocked until a predetermined layer thickness or accumulation of solid constituents or ice thickness has been reached. The distance is thus selected so that it is in the range of approximately 0.1 to 60 millimeters, preferably in the range of approximately 0.1 to 30 millimeters, and most preferably in a range of 0.1 to 5 millimeters. If a layer, such as an ice layer, is formed on the heat exchanger surface which has a layer thickness, or an ice layer thickness, that exceeds a predefined value, cooling is interrupted, so that the ice that has formed on the heat exchanger surface can thaw or can dissolve in the base mass or the layer can be removed or reduced. As soon as the (ice) layer thickness drops below a predefined value, or as soon as a predefined time window or another controlled variable is exceeded, cooling is continued. This process continues until a desired consistency of cooling mass, for example of ice slurry or sugar ice, has been reached. The finished, pumpable cooling mass, or the finished ice slurry or sugar ice, is pumpable and is withdrawn from the container via a draw-off point. The cooling temperature is accordingly set so that the base mass does not freeze completely. The cooling mass production device is designed to produce from approximately 5 kg to 20 kg of cooling mass per hour, and preferably from 25 kg to 250 kg.

In one embodiment, a food-safe cooling medium or coolant, for example glycol, temper, Thermera Friogel Neo or food-safe brine, food-safe sugar water or the like, is used as the cooling medium for cooling by way of the heat exchanger. In this way, the method and the device described hereafter for producing a cooling mass such as an ice slurry or sugar ice can be used in the food industry. In the event of a potential leakage, the food-safe cooling medium does not come in contact with the cooling mass or the ice slurry or sugar ice, and consequently there is no risk to users from contamination. A refrigerant for cooling the cooling medium flows through a secondary circuit. In other applications, for example when cooling concrete, rubber, oil, waste water or the like, a technical brine is used instead of a food-safe cooling medium. The method can thus also be used for fields other than the cooling of foodstuff. The method can in particular be used for all fields in which a pumpable, cooled base mass is produced from a flowable base mass, or thermal energy is withdrawn therefrom, so as to render it usable elsewhere. In general, a water/antifreeze mixture is used as the cooling medium in the concrete cooling example. The cooled, pumpable cooling mass is hereafter also referred to as cooling mass ice, or more concisely, as cooling ice. The base mass and cooling ice are mixed inside the housing. For this purpose, stirring by way of a stirrer is provided. The stirrer is located inside the housing. The actuator for driving the stirrer, or the stirring elements attached thereto, is located outside the housing. A force transmission unit such as a coupling and/or a gearbox is provided for force transmission. So as to implement the housing as leak-proof as possible, which is to say with the fewest possible apertures or through-passages, the force transmission is carried out in a contactless manner. This means that the stirrer disposed inside the housing is coupled in a contactless manner to the actuator disposed outside the housing. In a preferred embodiment, the coupling is carried out by way of a magnetic coupling. The magnetic coupling comprises a coupling part located outside the housing and a coupling part located inside the housing. The coupling parts cooperate magnetically with each other, whereby contactless coupling of the coupling parts, and thus of the stirrer and of the actuator, is ensured. The coupling part located on the inside is accordingly operatively connected to the stirrer. The coupling part located on the outside is accordingly operatively connected to the actuator.

In another embodiment, a temperature control agent/refrigerant is used as the temperature control/cooling medium for controlling the temperature/cooling, so that the method or the device is operated in a direct evaporator mode or as a direct evaporator. A refrigerant is $CO_2$ or the like, for example.

In one embodiment, it is provided that the temperature-controlling or cooling of the mass is carried out by controlling the temperature or cooling the mass to a temperature in the range of plus/minus 5 degrees around the melting point or freezing point, or within another temperature range of the base mass definable for foodstuff processing, preferably in a range of plus/minus 3 degrees around the melting point or freezing point or the defined temperature range, and most preferably around plus/minus 1.5 degrees around the melting point or freezing point or the defined temperature range.

One embodiment of the present invention provides for a layer thickness detection to be carried out. The layer thickness detection is carried out in a variety of ways, for example directly, by directly measuring the layer thickness, for example visually, haptically, by way of acoustic or other waves, or the like, or indirectly, for example by detecting derived variables. The layer thickness detection is preferably carried out indirectly. The layer thickness detection is carried out, for example, by way of stirring or by a distance between the ice and a stirring element. If the ice layer is too thick, stirring is blocked. As a result, the resistance increases for a stirrer carrying out the stirring. By detecting the resistance, it is possible to infer when an ice layer is too thick. Cooling is accordingly interrupted when the increase in resistance is sufficient. The interruption takes place in a time-controlled manner, an ice layer thickness-controlled manner, a temperature-controlled manner, or the like. For example, the interruption takes place for a preset or variable time period. In another embodiment, the interruption takes place as a function of the ice layer thickness, and in other embodiments as a function of the resistance, and in another embodiment, as a function of the power consumption of the actuator. In one embodiment, the layer thickness detection is carried out in a manner integrated with the stirring process.

In another embodiment of the present invention, it is provided that stirring takes place without contact with the heat exchanger device. Stirring takes place without contact with the heat exchanger device, and more particularly the heat exchanger surfaces. Stirring takes place along the heat exchanger surfaces, whereby thorough mixing of the ice formed on the heat exchanger surfaces, or of the layer formed there, and of the base mass, for example of the ice slurry brine or sugar water, is achieved. Parallel stirring in multiple locations is preferred. The stirring process is, in particular, designed as an axial and/or radial stirring process. In one embodiment, stirring takes place in a plane, for example in a plane parallel to the heat exchanger surfaces. The base mass, for example the ice slurry brine and/or the sugar water, and/or the ice or the cooling mass are preferably moved radially outwardly along the heat exchanger surfaces. In another embodiment, stirring takes place in at least one further direction, for example perpendicularly to the above-described direction.

Yet another embodiment of the present invention provides for the method to be carried out in a slanted position. In particular, at least the housing is inclined for carrying out the method. For this purpose, the housing, the heat exchanger device and/or the stirring device or the stirrer are oriented obliquely. With a slanted position, due to the differing properties of the cooling mass, for example the ice slurry or of the sugar ice, of the ice or the ice crystals, and the base mass, the base mass moves to the lowermost point of the housing, for example due to gravity. Due to the lower density, the finished cooling mass is moved to a higher point. Finished base mass ice or the cooling mass is thus situated in a higher position. The preferred base fluid is therefore water. Accordingly, cooling mass that is not yet finished, for example ice slurry or sugar ice that is not yet finished, for example the base mass such as the ice slurry brine or the sugar water, comprising non-mixed ice, will be situated at a lower point or location. By appropriately disposing a draw-off point in a higher or lower location, the finished cooling ice, or the finished cooling mass, for example the ice slurry, can thus be withdrawn from the container before the entire base mass has been converted into a cooling mass. In this way, improved cooling mass production can be achieved, since the cooling mass can be withdrawn sooner, and thus the base mass can be refilled sooner based on the level regulation or fill level control. In another use, the same device can be used to separate substances by separating substances from each other by way of thermal treatment by way of the differing substance density. The slanted position is controlled by way of a regulating unit, for example. In one embodiment, for example, an angular range of approximately 0° to approximately 90°, preferably of approximately 5° to approximately 35°, and most preferably an angular range of approximately 10° to approximately 20°, and preferably around 15° is set. Other values can likewise be set. In one embodiment, the slanted position is varied during the production of the cooling mass. For example, the slanted position is greater at the beginning of a production process and decreases over the course of the process. Cooling can be adjusted in keeping with the presently set slanted position.

For example, stronger cooling takes place with a more heavily slanted position, for example cooling takes place to an increased extent in the region of the lower-lying heat exchanger surfaces. In one embodiment, the fill level is set in keeping with the slanted position. For example, the fill level is lower with a more heavily slanted position. In one embodiment, originally higher-lying heat exchanger surfaces are activated and/or deactivated as the slanted position decreases.

Yet another embodiment of the present invention provides for the temperature-controlled base mass, and in particular the cooling ice, for example the ice slurry and/or the sugar ice, and/or the base mass, such as the ice slurry brine or the sugar water, to be conveyed in at least one direction, and preferably in multiple directions. A preferred direction is from the inlet to the outlet of the cooling ice or the base mass. As a result of the slanted position, conveying is supported by gravity, for example. In other embodiments, stirring devices or stirrers are provided, which convey by way of a helical movement, for example, such as by way of a spiral conveyor. Stirring preferably takes place along a plane of the appropriate heat exchanger surface. As a result of the slanted position or inclination and the differing properties of the cooling ice and of the base mass, mixing takes place transversely to the plane along which stirring is carried out.

One embodiment of the present invention moreover provides for temperature controlling/cooling to be carried out in parallel and/or in series on more than two surfaces of the heat exchanger device. Multiple surfaces are provided for cooling purposes. As a result of a slanted position or slanting, in particular also varying slanting, cooling does not constantly take place on the same fraction of all heat exchanger surfaces. Some of the cooling takes place in parallel. When the slanted position is changed, cooling takes place consecutively on a variable fraction of the heat exchanger surfaces. Individual heat exchanger surfaces can preferably be activated and/or deactivated.

In addition, one embodiment of the present invention provides for level regulation. The level regulation includes regulation of a fill level of the container, regulation of a concentration of the base mass, and regulation of a slanted position. The level regulation is carried out in particular as a function of different variables such as concentration variables, temperature variables, time variables, angle variables, fill level variables and the like. Dependencies of the individual variables are preferably detected. The regulation is preferably designed as a self-learning regulation. In one embodiment, automatic optimization is carried out based on the detected values, the actual values and the setpoint values, in particular as a function of target specifications.

Still another embodiment provides for temperature controlling/cooling to be carried out by way of indirect heat exchanger operation. For this purpose, a primary circuit and a secondary circuit are provided. For example, a food-safe brine is circulated in the primary cooling circuit. A refrigerant is circulated in the secondary circuit, for example. In another embodiment, direct heat exchanger operation having one circuit is provided. A refrigerant is circulated in the circuit, for example.

The invention encompasses the technical teaching that, in a method for air conditioning rooms, in which energy and/or heat is stored or buffered in a latent energy or heat storage system, or is withdrawn or extracted therefrom, it is provided that a temperature-controlled, and in particular cooled, pumpable mass, a cooled base mass, cooling mass ice or cooling ice, or cooling ice slurry or ice slurry, and more particularly a temperature-controlled mass produced according to a method according to the invention, or a produced cooling mass, is provided as the latent energy or heat storage system. For example, the energy that is stored in the temperature-controlled mass, and in particular in the cooling mass or the cooling ice, can be used not only for cooling, but also for heating rooms, process water, swimming pool water or the like, when using appropriately designed heat pumps and heating circuits. For this purpose, the ice slurry or cooling ice is appropriately stored and optionally refilled using appropriate control. Heating and/or cooling can be achieved when using cooling ice as an energy store. Switching between these is possible.

The invention moreover encompasses the technical teaching that, in a cooling mass production device, for example an ice slurry production device, for producing a flowable, pumpable, temperature-controlled, and in particular cooled, mass or cooling mass, cooling ice or ice slurry, in particular for use as foodstuffs and food products and/or for foodstuffs and food products, from a flowable base mass, for example a liquid ice slurry brine or liquid sugar water, it is provided that means for carrying out the method according to the invention are present. The means allow improved cooling mass production, for example ice slurry production, and more particularly allow cooling ice, cooling mass ice, cooling mass or ice slurry production that is faster and more energy-efficient, and optimized for large-scale production. Likewise, an improved heated mass can be produced analogously. Effective temperature-controlled mass production, and in particular cooling ice or ice slurry production, is achieved in particular by the flexible design, including changing the inclination or slanted position. The means, in particular, ensure continuous cooling ice or ice slurry production, or the continuous production of a temperature-controlled mass.

One embodiment of the present invention provides for the means to comprise a heat exchanger device, which includes multiple heat exchanger plates, which are disposed at a distance from each other, at least some of which being fluidically connected to each other, wherein stirring elements that comprise appropriate conveying or guide means are provided in between for stirring to the outside, wherein a contactless force transmission unit, and in particular a magnetic coupling, is provided for transmitting a force onto the stirring elements from outside the housing to the inside, so that the housing is designed without apertures in the region of the force transmission. The heat exchanger device comprises a heating or cooling agent circuit in which a heating or cooling agent can circulate or flow. The circuit comprises a feed and a drain. The heat exchanger plates are fluidically connected to the feed and the drain. The coolant flows through the interior space of the heat exchanger plates. A flow field is formed in the respective interior space, the flow field accordingly defining a flow of the coolant. For this purpose, corresponding flow guide means are provided in the interior space. These include protrusions, depressions, constrictions, widened regions, walls and the like. The interior space is delimited by appropriate walls. The lateral walls form the largest fraction of the walls in terms of expanse. The heat exchanger plates are preferably designed as plates having a circular cross-section, or as circular ring-shaped plates, having two side walls and one or two circumferential walls. The respective side wall has an outer side, this being the heat exchanger surface, and an inner side. The flow guide means extend from an inner side to the opposite inner side in one embodiment. In another embodiment, the flow guide means do not extend from an inner side to the opposite inner side, but project from one side in the direction of the other side, or transversely thereto, without making contact with the respective other side. The flow guide means have identical and/or different orientations. For example, an arbitrary flow field is formed in the interior space for optimized flow. An actuator is provided for operating the stirring elements or a stirrer comprising stirring elements. The stirrer is located in the housing in which the base mass is located, or in which the cooling ice is generated. The actuator, for example a motor such as an electric motor, optionally comprises a force multiplier, such as a gearbox, and is located outside the housing. A force transmission unit is provided for transmitting a force from the actuator to the stirrer. The force transmission unit is provided as a contactless force transmission unit. This unit comprises a first coupling part, which is cooperatively connected to the actuator. This unit further comprises a second coupling part, which is cooperatively connected to the stirrer. The two coupling parts are components of a force transmission unit designed as a coupling.

The coupling is preferably designed as a magnetic coupling in which the two coupling parts magnetically cooperate. The two coupling parts are disposed in a manner separated from each other by the housing. The coupling parts magnetically cooperate, wherein a magnetic field formed between the coupling parts penetrates the housing in the region of the coupling parts, whereby a magnetic coupling is implemented. The housing is preferably designed without apertures in the region of the coupling.

The heat exchanger plates preferably have a central through-passage, through which an axle or a shaft can extend, for example. The heat exchanger plates are preferably oriented concentrically with respect to each other. In one embodiment, the heat exchanger plates is connected to the feed or to the drain which is located outside the heat exchanger plates, so that the feed or the drain is disposed radially outside the heat exchanger plates. In another embodiment, a receptacle for at least a portion of the feed and/or of the drain is provided, which is integrated at least partially into the heat exchanger plates. For example, a respective through-passage for the feed and/or the drain is provided in the respective heat exchanger plate. The respective heat exchanger plate accordingly is connected to the feed or drain which is located inside the heat exchanger plate. Preferably multiple heat exchanger plates are oriented parallel to each other along an at least imaginary axis extending through the heat exchanger plates. The heat exchanger plates are preferably designed rotationally symmetrical with respect to the axis. Eccentric forms are provided in other embodiments. In one embodiment, the heat exchanger plates are disposed at a fixed distance from each other. The heat exchanger plates are preferably designed to have the same distance from each other. In other embodiments, the heat exchanger plates are spaced differently from each other, for example at different distances. In another embodiment, the heat exchanger plates are disposed at variable distances from each other. For example, the heat exchanger plates can thus be disposed more closely together or further apart from each other. In this way advantages can be achieved, in particular for transport or for a changed slanted position during operation. In one embodiment, a locking mechanism for locking the respective heat exchanger plate in a position is provided.

In another embodiment of the present invention, it is provided that the means comprise a regulating device for up-regulating or down-regulating the heat exchanger device when a mass layer thickness of at least one mass adhering to a heat exchanger plate, for example an (ice slurry) layer thickness, is exceeded, and up-regulating or down-regulating the heat exchanger device in the event of a drop below the mass layer thickness or the (ice slurry) layer thickness. Down-regulating or up-regulating refers to changing the power of the heat exchanger device, for example so as to lower (down-regulate) or raise (up-regulate) a cooling power. The regulating device includes an (ice) layer thickness consistency or temperature detection.

According to another embodiment of the present invention, a stirring device, which is disposed at a distance from the heat exchanger device, is provided for stirring the base mass, for example the ice slurry brine or the sugar water, and/or the cooling mass or the cooling ice, for example the ice slurry or the sugar ice, without making contact with the heat exchanger device. The stirring device is designed so as not to make contact with the heat exchanger device, and more particularly with the heat exchanger plates. The stirring device preferably comprises a drive unit, and preferably a drive shaft. The drive shaft is preferably disposed through the central through-passages of the heat exchanger plates. To this end, the drive shaft is disposed at a distance from the heat exchanger plates. Stirring elements, which are disposed at a distance from the respective heat exchanger plates, project radially from the drive shaft. The stirring elements are designed as stirring rakes, for example. In another embodiment, the stirring elements are designed as stirring paddles. In still another embodiment, the stirring elements are designed as stirring rods. Yet another embodiment provides for the stirring elements to be designed as stirring brushes, and another embodiment is a combination of these. Further embodiments of the stirring elements are conceivable. The stirring elements are rotated by the drive shaft in the intermediate space between two neighboring heat exchanger plates. As a result, they push the cooling mass, cooling ice or ice slurry, or the base mass, ice slurry brine or sugar water radially outward. Since the drive shaft is disposed at a distance from the respective heat exchanger plate, the base mass, ice slurry brine or ice slurry can move up. For stirring to the outside, the stirring elements comprise appropriate conveying or guide means. The stirring device or the stirrer is coupled to the regulating unit, or is at least partially integrated therein. The regulating unit assumes the switching of stirring intervals, stirring speed and the like. The controlled variable that is used can be base mass or brine or sugar and/or ice slurry consistency, the power consumption, such as that of the stirrer motor, the temperature of the container wall and/or of the container contents or the like.

Moreover, in one embodiment of the present invention, it is provided that the means include an inclination regulating unit so as to incline the cooling mass, cooling ice or ice slurry production device. The inclination regulating unit is preferably disposed on the outside of the container in which the heat exchanger device and the stirring device are disposed. The inclination regulating unit preferably comprises one or more extendable and/or pivotable pedestals, mountings or the like. In one embodiment, a weighing device is provided, on which the container is disposed. Weighing feet, measuring cells or weighing sensors are accordingly provided, in the place of simple pedestals. In this way, it is possible to detect the weight and/or regulate or control the weight when drawing off or supplying ice slurry or base mass. In particular, a metering device can thus be implemented by way of weight control. In one embodiment, a level detection unit is provided for, which detects an angle of inclination. In another embodiment a drive is provided, for example a hydraulic drive, pneumatic drive or another drive.

Moreover, according to one embodiment of the present invention, the means include a conveying device, preferably integrated into the stirrer, so as to convey the ice slurry or the base mass. Conveying preferably occurs from an inlet to an outlet. For example, the inlet and the outlet are not located at the same height. The outlet is preferably located at a higher level, so that conveying occurs in the direction of the outlet with an appropriate inclination.

The invention further encompasses the technical teaching that, in an energy system, and in particular in an air conditioning system for air conditioning rooms and/or for heating process water or the like, serving as a heat and energy source for heat pump systems, in which energy and/or heat is stored in a latent energy or heat storage system and/or extracted or discharged therefrom, it is provided that a cooling mass, a cooling ice or an ice slurry production device according to the invention for carrying out a method according to the invention is included, so as to provide cooling ice or ice slurry, and more particularly cooling ice or ice slurry produced using the cooling mass or ice slurry production device according to the invention, as the latent energy or heat storage system.

Finally, the invention encompasses the technical teaching that use of flowable, pumpable cooling mass, cooling ice or ice slurry, and more particularly of cooling ice or ice slurry produced according to a method according to the invention and/or produced using a cooling mass, a cooling ice or an ice slurry production device according to the invention, as a latent energy or heat storage system is provided, in particular for cooling foodstuffs such as in fresh fish refrigeration, dough refrigeration, in energy or heat storage such as the storage of latent energy or heat in energy or thermal systems, or in energy or heat recovery systems and the like.

In one embodiment, the device is used for the operation with a heat pump. In this process, the cooling ice/ice slurry is incurred as a waste product, for example. By using ice slurry in such a system, a high energy performance latent heat storage system is implemented.

When using a device, heat from solar radiation and/or heat from the ambient air is used. A portion of the heat is buffered in the ice water storage tank, where the heat is stored substantially loss-free. Thanks to the extremely high heat transfer in the water/ice storage tank, the same has a capacity of 300 to 400 liters, for example. During the summer, the heat pump requires no energy or only very little energy. When it is used as a heating device, the heating device preferably comprises at least one hybrid collector, a heat pump, a liquid ice storage tank, and a heat storage system. In particular space-saving energy storage systems are provided as the liquid ice storage tank or water/ice storage tank. In conjunction with a heat pump, energy can be used at a usable temperature level, for example for heating a room and/or for heating hot water. The closer the required usage temperature is to the melting point of water, the higher the efficiency, and the lower the current for the heat pump in order to achieve the desired temperature. The components of a corresponding heating device—the ice storage tank, the collector and the heat pump—are designed for the respective heat requirements. An adsorber is running continuously, which is to say during the day and also at night. Special hybrid collectors still absorb sufficient heat even with diffuse brightness levels and under cloudy conditions, so as to convert the same into usable heat thereafter or store the excess supply in the (liquid) ice storage tank. During summer days, hot water supply can be handled directly by collectors, without the heat pump, by conducting the heat into the buffer storage unit. During the winter, the energy is conducted into the heater or the buffer storage unit, if the temperatures of the collectors are sufficient. If the temperatures are not sufficient, the heat is brought to the usable temperature by the heat pump or stored in the ice storage tank on an intermediate basis. The hot water storage tank keeps the heat energy available that is required for generating hot water. In this way, heating using ice or liquid ice is possible in a simple manner. Heating using ice is based on the following physical principle: the so-called heat of crystallization can be extracted as a result of the formation of crystals by way of energy withdrawal during ice formation. During thawing, exactly the same heat must be supplied again. This can be repeated any arbitrary number of times and is a characteristic of water as a medium. The water/ice storage tank or liquid ice storage tank is not used as the actual heat source for this purpose, but always as an intermediate storage unit that is loaded and unloaded any arbitrary number of times. Heat is withdrawn from the liquid ice storage tank as follows: heat is extracted from the water by way of a heat pump until ice forms. With powerful ice storage heat exchangers, the heat pump operates particularly efficiently until the water has completely frozen having a freezing temperature of 0 degrees, since the operating temperature of the heat pump does not drop. It is important for high heat transmission in the high performance ice storage tank that the heat exchangers have a large surface and that there be a small distance of just a few centimeters at the heat exchanger surfaces. The heat extracted by the heat pump can be used at a higher (usable) temperature by the heat pump dissipating this heat to a buffer storage unit for heating, or for heating water. Preferably liquid ice is used, which is made available via the device according to the invention. In this case, the device forms part of the heating device. The heat supply via the ice storage tank takes place as follows: energy or heat can be supplied to the ice storage tank, for example, by way of an air-to-air heat exchanger comprising a fan, solar collectors, or a combination thereof, known as hybrid collectors. The more efficiently the collectors operate, for example, being even able to cause snow to slide off or thaw, the smaller the ice storage tank can be. In this case, a design intended for one night is sufficient, since even a cloudy sky the next day suffices to harvest sufficient energy again via the collectors. Instead of an ice storage tank, or in addition to this, a liquid ice storage tank is preferably provided. The energy that is extracted from the ice during freezing can be used for heating purposes. This offers two important advantages: ice storage tanks, and more particularly liquid ice storage tanks, are relatively inexpensive and extremely space-saving. The operating principle is as follows: when one liter of ice having a temperature of zero degrees Celsius is converted into water (thawed), the energy that is required is the same as when heating one liter of water having a temperature of zero degrees Celsius to eighty degrees Celsius. In this way, eight times the amount of energy can be stored in the same volume as compared to a water storage tank. Due to the involvement of a heat pump, low-temperature energy can be rendered usable by bringing it to appropriate temperatures for heating and for heating hot water. As a result of the high energy density, a large amount of space can be saved. The liquid ice generator differs drastically with regard to the method of producing the ice in terms of the type of ice used—which is to say, solidly frozen water with ice heating, as compared to liquid ice brine or sugar ice or another technical ice or the like with the liquid ice generator. Cooling ice, liquid ice, ice slurry or pumpable ice is preferably used here. When using the liquid ice generator, a closely similar kind of energy extraction (energy recovery) and storage can be practiced. The advantage of liquid ice is that it thaws very quickly even when small amounts of heat are supplied. In this way, the liquid ice generator can be used very well as a renewable heat source for heat pumps, even at very low temperatures just above 0° C., and with weak solar radiation.

Furthermore, the invention encompasses the technical teaching that this may be used to produce a kind of thermal energy transformer, in which a large amount of energy is to be produced using a small energy source with the factor of time, which can then be withdraw again within a very short time, or stored over a longer, but delayed time period. In this way, it is possible to efficiently cover and compensate for high cooling energy peaks using little mass, which is however very energy-efficient. Examples include water cooling in snow making machines. During the cold night-time hours, a large amount of energy is collected using "free cooling," which can be retrieved during the daytime during warmer hours. Further examples of very high cooling power include building air conditioning, process cooling in metal processing, harvesting and processing operations for fruits and vegetables such as asparagus, process cooling in foodstuff production, polymer and injection molding machine cooling, dye baths, anodizing baths, print shops, the paint industry, IT processor cooling, fermentation and brewing processes, beverage production or the like.

In a preferred embodiment, the base mass used is a sugar water solution. This is cooled using the method according to the invention, so that pumpable sugar ice is created. This is used in the production of dough. This sugar ice is used in particular for baked goods. The sugar ice is introduced into a dough base mass. The sugar ice cools the existing dough base mass, so that this can be further processed at low temperatures in a way that is suitable for foodstuffs. In addition, the sugar ice blends with the existing dough base mass. Accordingly, less water or sugar than before is needed for a dough base mass since these components are added to the dough base mass by introducing sugar ice. Introducing sugar ice has not been known, especially for making waffles or when baking other confectionaries and/or pastries. In this respect, one embodiment provides for sugar ice, which is preferably produced according to one of the above-described method steps, to be introduced into a dough base mass when producing a dough for pastries and/or confectionaries. One embodiment preferably provides for sugar ice to be introduced into a base dough mass in the production of a confectionary and/or pastry product. The mixture of the dough base mass and the sugar ice is baked in a later step. The product thus created has a higher quality at a lower complexity. Accordingly, a confectionary and/or pastry product is provided in one embodiment, which is produced according to one of the above-described methods. The sugar ice can thus be used for process cooling, and in particular in the production of dough. Sugar ice is additionally used for introducing, in a cooled manner, additions into the dough which are present in the sugar ice.

Another application example of the method according to the invention or the device according to the invention is the use in butcher shops and/or meat markets. Here, cooling ice is introduced into a meat paste. The cooling ice cools the meat paste, so that this can be further processed at low temperatures, such as kneaded, minced or the like. Furthermore, an addition, such as water and salt, is introduced into the meat paste.

The meat paste base mass accordingly includes fewer constituent parts of water and salt, or constituents contained in the cooling mass. The cooling ice can also be used in the production of pizza dough and similar products made from dough. The base mass includes appropriate constituents, which are used later in the dough. Admixing cooling mass ensures a low processing temperature for the dough. In another embodiment, the principle according to the invention can be reversed. To the extent this is required for foodstuff production, the base mass is not cooled, but heated using the heat exchangers that are present. The device can thus also be used for process control purposes, where it is not cooling but heating that is sought.

Another application example for the method according to the invention or the device according to the invention is the use in direct and continuous cooling by way of the device after cooking processes of masses and foodstuffs, such as preserves, jam, apple sauce, mash, rice pudding, gravies or the like after the cooking process. The predefined temperatures and cooling times are hygienically and efficiently achieved here, in accordance with the stipulations of HACCP regulations. This allows a more rapid integration with the cold chain, further processing or packing, or the like.

In one embodiment of the invention, a method for continuous production shall be understood to mean a method in which the horizontal and/or vertical positions of the container or the housing in which the base mass or mass is located are not changed, and in particular in which the container or the housing is not tilted or pivoted, so as to move the base mass or mass out of the same, for example. Rather, the production in the housing/container takes place without tilting. In a preferred embodiment, the container/the housing in which the base mass or mass is located is disposed in a positionally fixed manner, at least for the duration of the production process. In one embodiment, the container is disposed non-rotatably, for example. The container thus does not rotate about the longitudinal axis of the container or another axis to produce ice slurry. The method for producing the ice slurry is carried out using an immovable container. During the production process, thus only the stirring elements rotate or move with respect to the heat exchanger plates and the container. The heat exchanger device, or more concisely, the heat exchanger, and/or the container are positionally fixed, which is to say they are not tilted, not rotated, or rotated in another manner. Only the stirring elements are rotated. During withdrawal of the ice slurry and during production of the ice slurry, the container and/or the heat exchanger plates are disposed so as to be positionally fixed, which is to say non-rotatably and/or immovably. It is possible to withdraw the ice slurry during the production process, and in particular without moving the container and/or the heat exchanger. Only the stirring elements are disposed so as to be movable.

The invention also encompasses the technical teaching that a heat exchanger is provided, which comprises multiple heat exchanger plates disposed at a distance from each other. The heat exchanger plates are fluidically connected to each other. Furthermore, the heat exchanger plates each have a through-passage through which a drive of a shaft/axle and/or the shaft/axle of a stirrer extends. Stirring elements project radially and/or transversely from the drive/shaft/axle between the heat exchanger plates. The drive and/or the stirring elements are designed so as to be movable between the heat exchanger plates. The stirring elements are non-rotatably connected to the drive. Accordingly, the stirring elements can be moved between neighboring heat exchanger plates. The heat exchanger plates have any arbitrary contour, as seen from above. In one embodiment, the heat exchanger plates are circular. In other embodiments, the heat exchanger plates are oval, rounded, angular, quadrangular, polygonal, rectangular, square or the like. The heat exchanger plates are fluidically connected to each other via a feed line and a discharge line. The heat exchanger plates are preferably connected to the feed line and/or the discharge line at an outer edge of the heat exchanger plates. In other embodiments, a fluidic connection is established between the through-passage and the outer edge. The heat exchanger plates comprise two plates, which are spaced from each other and connected to each other at the edges thereof—inside and outside—in a fluid-tight manner, so that the plates form a fluid-tight interior space. The interior space is fluidically connected to the feed and the drain via appropriate fluidic connections. Flow guide means are provided in the interior space, which cause an optimized flow of the fluid from the feed to the drain through the interior space. This simple design allows the heat exchanger to be configured for many applications. For example, the heat exchanger can be used in kettles to increase the heat transfer surface area.

The invention will be described hereafter in greater detail based on exemplary embodiments shown in the drawings. Uniform reference numerals are used for identical or similar components or features. Features or components of different embodiments can be combined so as to obtain further embodiments. All of the features and/or advantages that are apparent from the claims, the description or the drawings, including design details, arrangement in terms of space, and method steps, can thus be essential to the invention, both alone and in a wide variety of combinations.

DETAILED DESCRIPTION OF THE INVENTION

Figure 1:
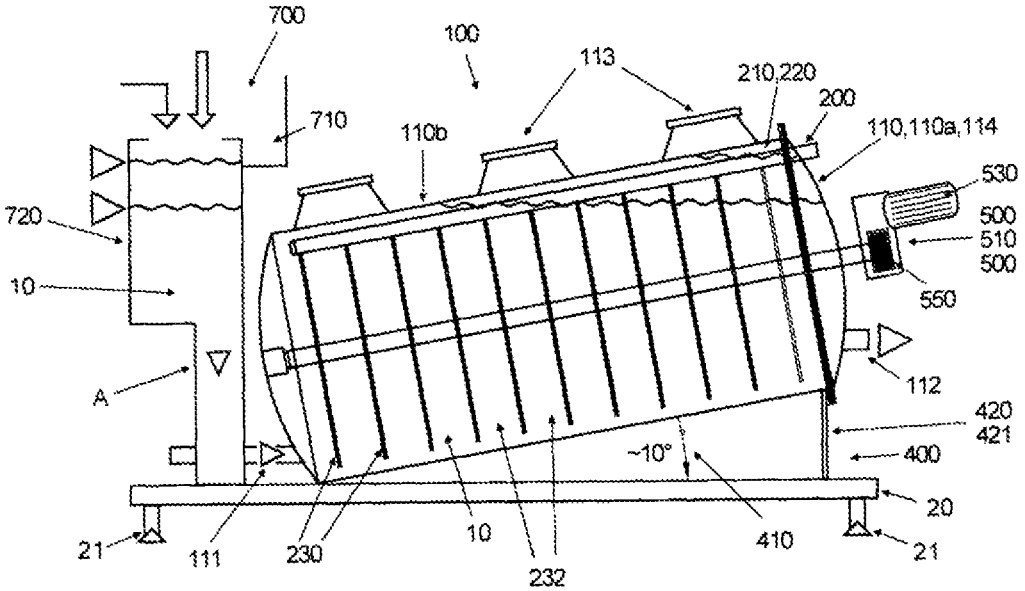
FIG. 1 schematically shows a cross-sectional view of an ice slurry production device.

FIGS. 1 to 14 show different embodiments of a heat exchanger device 100 in different views and levels of details. Identical or similar components are denoted by identical reference numerals. A detailed description of components that were already described is dispensed with.

The cooling mass production device 100 for producing a cooling mass, and in particular ice slurry, from a liquid base mass, ice slurry brine or sugar water comprises means for carrying out a method for producing a temperature-controlled mass, cooling mass, ice slurry from a base mass 10, such as an ice slurry brine or sugar water, wherein a housing 110 is filled with the liquid base mass 10, such as an ice slurry brine, the liquid base mass 10, such as the ice slurry brine, is cooled by bringing it into contact with a heat exchanger device 200 disposed in the housing 110 while stirring the base mass 10, such as the ice slurry brine or the sugar water, so as to generate the temperature-controlled mass, the cooling ice, or the ice slurry or the sugar ice, wherein, when an ice layer forms on the heat exchanger device 200, cooling is interrupted as soon as the ice layer reaches a predetermined thickness, and cooling is continued as soon as the ice layer drops below the predetermined thickness.

The cooling mass production device 100 comprises corresponding means, which include the heat exchanger device 200. The means further include a regulating device. The means moreover include a stirring device 500. The means additionally include an inclination regulating unit 400. The means further include a conveying device 600. The cooling mass production device 100 is disposed on a floor or a support base 20, which can also be designed as a weighing device. The inclination regulating unit 400 can be used to bring the cooling mass or ice slurry production device 100 into a slanted position, or to incline it, with respect to the support base 20, as is shown in FIG. 1. An angle of inclination 410, at which the cooling mass production device 100 is inclined with respect to the support base 20, can be set by way of the inclination regulating unit 400. The angle of inclination 410 is calculated here from a slanted position of the housing 110 of the cooling mass production device 100, or an axis A of the cooling mass production device 100, with respect to the support base 20. The inclination regulating unit 400 comprises at least one adjustable inclination element 420, which can be extended. The inclination element 420 is designed as an extendable pedestal 421 here. The support base 20 is preferably part of the inclination regulating unit 400. For the cooling mass production device 100 to rest on a supporting structure, the inclination regulating unit 400 comprises appropriate pedestals 21, which can also be designed as weighing feet.

In addition to the base mass 10, and in particular the ice slurry brine or the sugar water, the heat exchanger device 200 is also disposed, at least partially, in the container 110. The heat exchanger device 200 comprises a flow or feed 210 for a heating or refrigerating agent (in short: a refrigerant), a drain or return 220 for the refrigerant, and multiple heat exchanger plates 230 that are fluidically connected to the flow 210 and the return 220. The refrigerant can flow through the heat exchanger plates 230. So as to achieve optimal flow, the heat exchanger plates 230 have an interior space, which is surrounded by two end-face side walls and a wall disposed in the manner of a lateral face thereto, and the interior space is fluidically connected both to the flow 210 and to the return 220. For the formation of an appropriate through-flow, various flow guide means 235 are disposed in the interior space so as to implement a particular flow field, for example. The flow 210 and the return 220 are disposed eccentrically relative to the heat exchanger plates 230. The flow 210 and the return 220 extend in the axial direction A. The housing 110 further comprises a supply point 111 and a draw-off point 112. As is indicated by the arrows at 111 and 112, the supply of base mass 10, such as ice slurry brine or sugar water, or the removal of cooling ice or ice slurry, takes place accordingly.

The base mass 10 is supplied to the container or the housing 110 via the supply point 111. For this purpose, the base mass 10 is supplied to the housing 110 via a level regulating unit 700. The level regulating unit 700 comprises a first brine container 710 and a second brine container 720. A saturated base mass 10 is stocked in the first brine container 710, for example a saturated salt solution. The second brine container 720 holds the base mass 10 having a desired base mass concentration, for example a 0.5 to 3.5% salt solution (volume % or mass %). So as to obtain the desired concentration value, the concentration in the second brine container 720 is detected. If the concentration exceeds the desired concentration value, the base mass 10 is diluted, for example by feeding in base mass 10 having a lower concentration, or water. If the concentration is below the desired concentration value, the base mass 10 is concentrated, for example by supplying base mass 10 having a higher concentration, preferably using the saturated base mass 10 from the first brine container 710. If a desired concentration is present, the base mass 10 from the second brine container 720 is supplied to the container 110. Supply takes place in keeping with the level regulating unit 700. In addition to regulating the concentration of the base mass 10, this unit regulates, in particular, the base mass 10 in the second brine container 720, as well as other parameters. For example, the level regulating unit 700 also regulates a fill level of the base mass 10 in the container 110. For example, this is done by way of a float gauge measurement, visually or using other means. So as to produce ice slurry from the base mass 10, the base mass 10 is cooled, and more particularly pre-cooled, in the container 110. For this purpose, the level regulating unit 700 includes a refrigeration controller or a corresponding refrigeration circuit. The base mass 10 is cooled by bringing it in contact with heat exchanger surfaces of the heat exchanger plates 230. To produce ice slurry, it is necessary to mix base mass 10 and crystallized or frozen base mass 10. This is done by way of the stirring device 500. The stirring device 500 comprises a stirring drive 510. The stirring drive 510 comprises a stirring shaft 520 and a stirring motor 530 driving the stirring shaft 520. The stirring shaft 520 is disposed centrically relative to the heat exchanger plates 230. For this purpose, the heat exchanger plates 230 each have a central through-passage 231, through which the stirring shaft 520 extends. Projecting radially outwardly, the stirring shaft 520 comprises stirring elements 540, which are designed to mix or stir the base mass 10, or the ice slurry, or the mixture of both. The stirring elements 540 are disposed in the intermediate spaces 232 between the heat exchanger plates 230. The stirring elements 540 have a paddle design, so that the base mass 10 or the ice slurry is moved radially outwardly away from the stirring shaft 520 in the direction of the container wall 110*b*. The base mass mixture that is richer in ice is preferably transported radially outwardly. The base mass mixture containing less ice, or the base mass 10, follows in through the through-passages 231 of the heat exchanger plates 230. In this way, efficient mixing is achieved. Moreover, improved mixing takes place due to the slanted position of the container 110, and thus of the heat exchanger device 100 and the stirring device 500. Mixing is supported by the action of gravity. So as to additionally convey the ice slurry or the base mass 10, the appropriate conveying device 600 is provided. This is integrated into the stirring device 500 in the embodiments shown here, in particular by the shape of the stirring elements 540. The conveying device 600 is also partially integrated into the inclination regulating unit 400 since the slanted position supports conveying of the ice slurry or of the base mass 10. Due to the slanted position and the lower density of the ice slurry compared to the base mass 10, the ice slurry moves from the lowest point, where the supply point 111 is located, toward a higher location. The draw-off point 112 is formed at the higher location. The slanted position ensures that the ice slurry, or depending on the slanted position an ice slurry mixture having a lower content of base mass 10, is present at the draw-off point 112 and can be drawn off there. So as to accelerate the ice slurry production process, drawn-off ice slurry or ice slurry mixture can be recirculated to the supply point 111 and re-supplied to the container 10. The slanted position can be adjusted for this purpose, for example.

FIG. 1 schematically shows a cross-sectional view of the ice slurry production device 100. Here, the composition is schematically illustrated. The container 110 has three maintenance openings 113. The set angle of inclination is approximately 10°. The container 110 is filled almost to the rim. Two different fill levels are indicated, which can be set by way of the level regulating unit 700. The stirring shaft 520 is mounted on an end-face wall or end face 110*a* of the container 110 near the supply point 111. The stirring motor 530 is provided on the opposite side. It is located outside the container 110. A magnetic coupling 520 is provided for driving the stirring shaft 520, without penetration or through-passage, on the appropriate end wall or end face 110*a* of the container 110, which is on the draw-off point side here. It is possible to drive the stirring shaft 520 from the outside by way of this, without penetration, and thus without sealing of the end face 110*a*. As a result of the slanted position, a pressure exerted by the base mass 10, or the ice slurry, on the end face 110*a* is lower than in the horizontal position.

Figure 2:
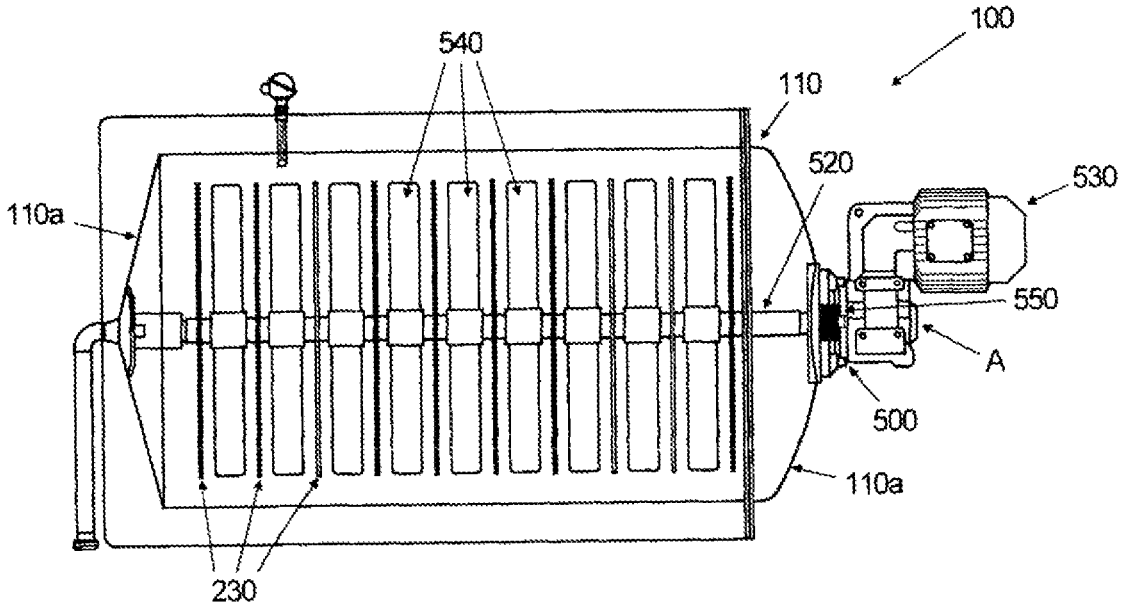
FIG. 2 schematically shows a section of an ice slurry production device in another cross-sectional view.

FIG. 2 schematically shows a section of the cooling mass production device 100 in another cross-sectional view. The level regulating unit 700 is not shown here. As in FIG. 1, the insulated container or the housing 110 is designed as a thin-walled, approximately cylindrical container 110 having two end faces 110*a* that curve slightly to the outside. The container 110 accordingly extends along the axial direction A. The central axis of the container 110 and the central axis of the stirring shaft 520 are formed concentrically with respect to each other. The stirring shaft 520 is coupled to the stirring motor 530 by way of the magnetic coupling 550. Since no opening is required in the corresponding end face as a result of the magnetic coupling 550, the arrangement of the magnetic coupling 550 and of the stirring shaft 520 can be freely selected, which is to say these may also be provided on the lower-lying end face. The heat exchanger plates 230 are designed as circular ring-shaped plates and project radially outwardly from an imaginary central axis. The imaginary central axis of the heat exchanger plates 230 is disposed concentrically with respect to the central axis of the stirring shaft 520 and of the container 110. The heat exchanger plates 230 are disposed at identical distances from each other in the axial direction A. Radially, the heat exchanger plates 230 are disposed at identical distances from the side wall 110*b* of the container 110. The stirring elements 540 are disposed between the heat exchanger plates 230 so as to project radially outward. The stirring elements 540 are formed at identical distances from each other in the axial direction A and have substantially identical designs. The stirring elements 540 are disposed at a distance from the heat exchanger plates 230 for contactless stirring. The stirring elements 540 are formed at a distance from the side wall 110*b* of the container 110 in the axial direction A.

Figure 3:
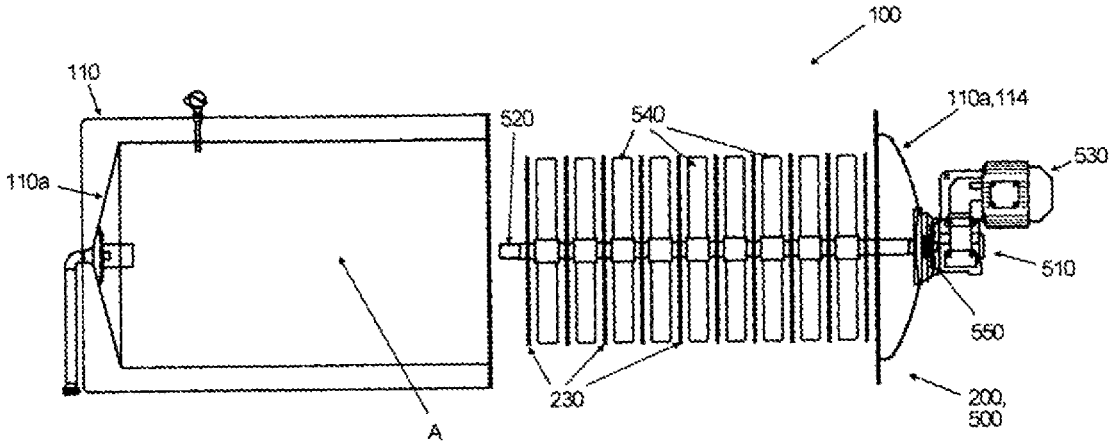
FIG. 3 schematically shows an exploded illustration of the ice slurry production device of FIG. 2.

FIG. 3 schematically shows an exploded illustration of the cooling mass production device 100 of FIG. 2. The heat exchanger device 200 is preferably integrated with the stirring device 500, so that both can be inserted into the container 110 together during installation. A cover 114 of the container 110, which is designed as a removable end wall 110*a*, is preferably likewise integrated with the heat exchanger device 200 and/or the stirring device 500. Due to the magnetic coupling 550, the end wall 110 is designed without openings in the axial direction in the region of the stirring shaft 520.

Figure 4:
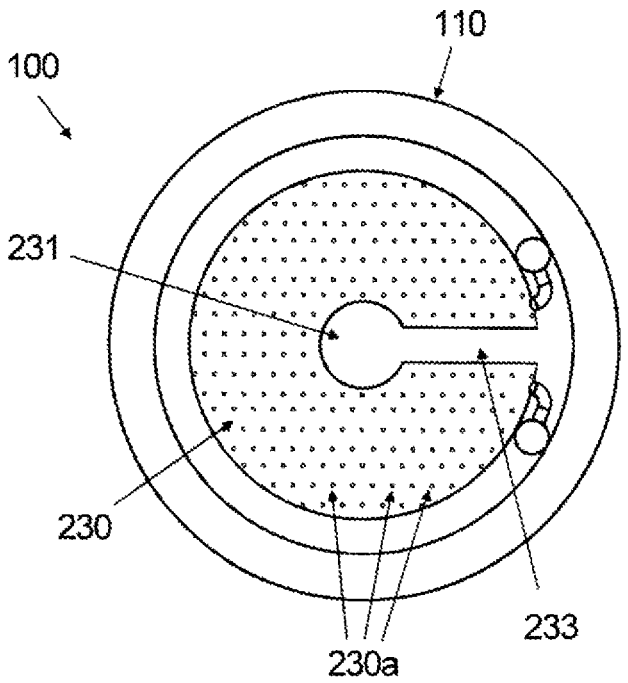
FIG. 4 schematically shows another cross-sectional view of the ice slurry production device of FIG. 3.

FIG. 4 schematically shows another cross-sectional view of the cooling mass production device 100 of FIG. 3. The view does not show the stirring device 500. The container 110 has a substantially hollow-cylindrical design. The heat exchanger plates 230 are disposed at radially constant distances from the side wall 110*b* of the container 110. The heat exchanger plates 230 have the central through-passage 231 for the stirring shaft 520. The central axis of the through-passage 231 is concentric with respect to the center axis of the container 110. The interior space of the heat exchanger plates 230 has a flow field. The flow field is also defined by welds, depressions or other flow guide means 235 of the heat exchanger surfaces in the direction of the interior space. A slot 233 for a lateral installation of the stirring shaft 540 into the through-passage 231 extends radially outwardly from the central through-passage 231. The feed 210 and the drain 220 are disposed between a radially outer edge of the heat exchanger plate 230 and the side wall 110*b* of the container 110. The feed 210 and the drain 220 extend in the axial direction A.

Figure 5:
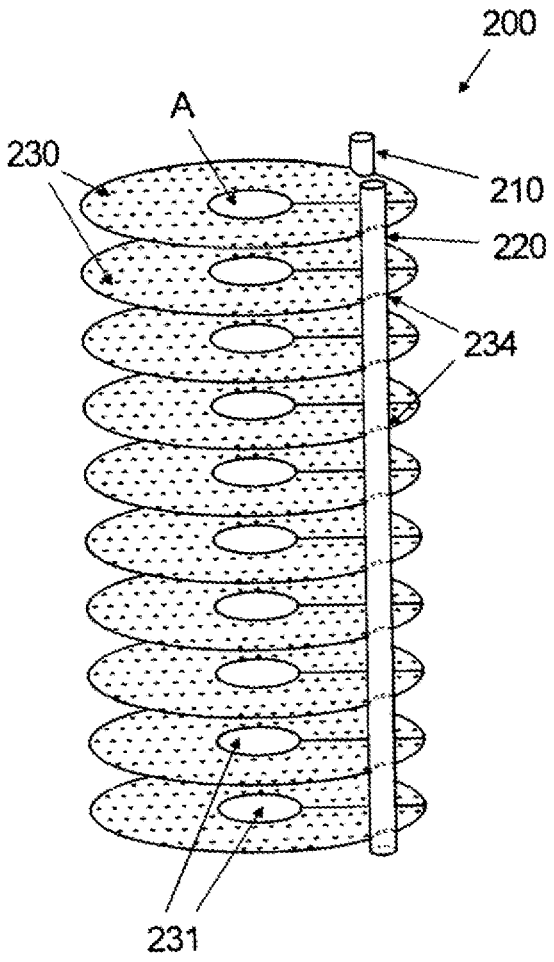
FIG. 5 schematically shows a perspective view of a heat exchanger device of an ice slurry production device.

FIG. 5 schematically shows a perspective view of another heat exchanger device 200 of the cooling mass production device 100. In the embodiment shown here, the heat exchanger plates 230 have no slot 233. The stirring shaft 520 is inserted axially through the through-passages 231 here. The flow 210 and the return 220 are partially accommodated in the heat exchanger plates 230. The heat exchanger plates 230 have appropriate receptacles 234 for this purpose, as is shown in FIG. 6.

Figure 6:
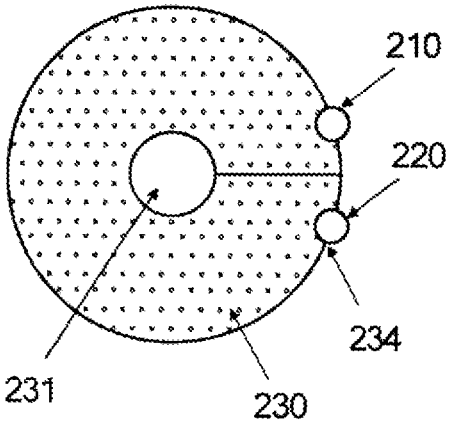
FIG. 6 schematically shows a top view onto the heat exchanger device of FIG. 5.

FIG. 6 schematically shows a top view onto the heat exchanger device 200 of FIG. 5. The receptacles 234 for the flow 210 and the return 220 are formed on an outer edge of the heat exchanger plate 230, wherein these interrupt the edge. A feed 210 and/or return 220 received there protrudes over the edge in the direction of the side wall 110*b* of the container 110. A fluidic connection of the interior space of the heat exchanger plate 230 to the feed 210 or the drain 220 is thus established without external connecting means, but is integrated.

Figure 7:
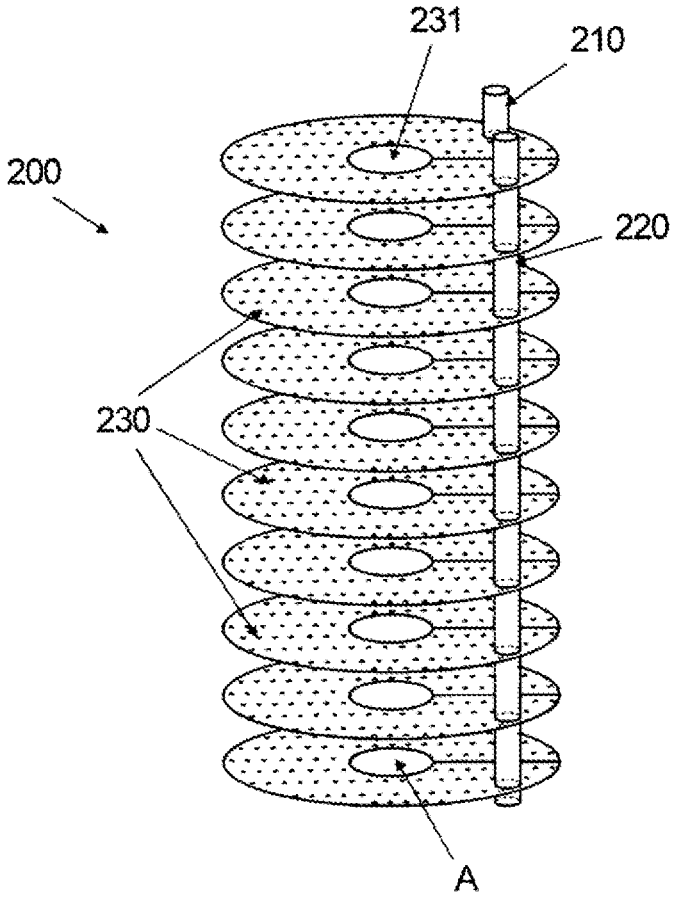
FIG. 7 schematically shows a perspective view of another heat exchanger device of an ice slurry production device.

FIG. 7 schematically shows a perspective view of another heat exchanger device 200 of a cooling mass production device 100. Having a composition that is otherwise identical to that of the exemplary embodiment according to FIGS. 5 and 6, the embodiment according to FIG. 7 includes receptacles 234 that do not interrupt the edge, but are designed as eccentric through-passages in the heat exchanger plate 230. A feed 210 or drain 220 received there does not protrude radially over the edge of the heat exchanger plate P33.

Thus, the radial distance from the heat exchanger plates 230 to the side wall 110*b* of the container 110 must be dimensioned smaller.

Figure 8:
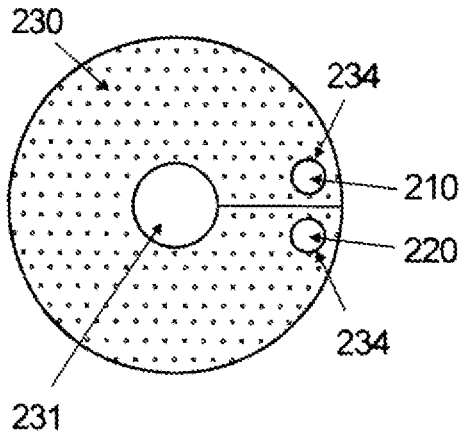
FIG. 8 schematically shows a top view onto the heat exchanger device of FIG. 7.

FIG. 8 schematically shows a top view onto the heat exchanger device 200 of FIG. 7. The two receptacles 234 designed as through-passages penetrate the heat exchanger plate 230, wherein the cross-section of the receptacle 234 is located completely inside the corresponding cross-section of the heat exchanger plate 230. One embodiment of the cooling mass production device 100 including the heat exchanger device 200 according to FIG. 4 is shown in FIG. 9.

Figure 9:
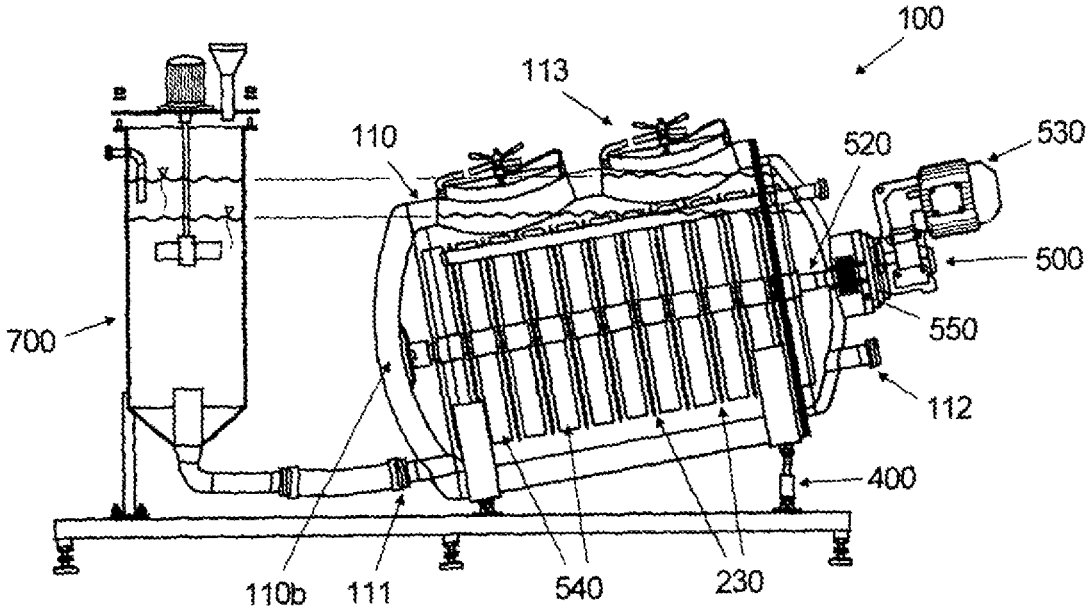
FIG. 9 schematically shows a side view of an ice slurry production device.

FIG. 9 schematically shows a side view of the cooling mass production device 100 including the heat exchanger device 200 of FIG. 8. The feed 210 and the return 220 do not extend in the radial direction laterally from the heat exchanger plates 230, but penetrate these. In this way, a uniform distance is achieved in the radial direction between the heat exchanger plates 230 and the housing 110. The composition shown in FIG. 9 essentially corresponds to the exemplary embodiment of FIG. 1. The cooling mass production device 100 has a more compact design, comprising a container 110 having two maintenance openings 113. The heat exchanger device 200 comprises nine heat exchanger plates 230. The stirring device 500 comprises ten stirring elements 540. The end face, or the end faces, facing the stirring shaft 520 is or are designed without openings since the stirring shaft 520 is coupled, or can be coupled, to the stirring motor 530 via the magnetic coupling 550 without making contact.

Figure 10:
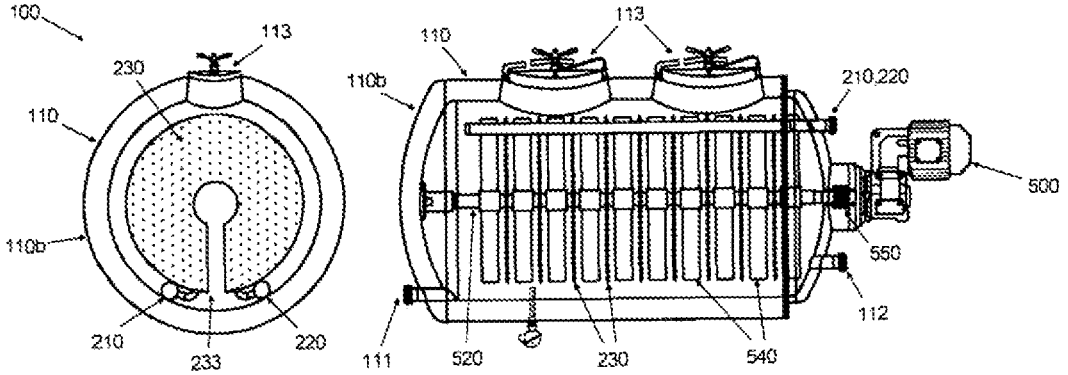
FIG. 10 schematically shows a front view and a side view of a section of the ice slurry production device of FIG. 9.
Figure 11:
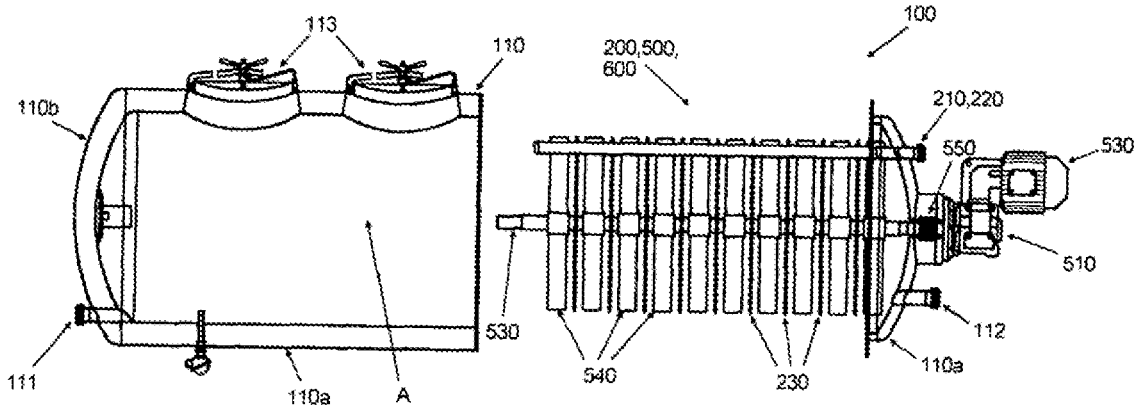
FIG. 11 schematically shows a partially exploded side view of the ice slurry production device of FIG. 10.

FIG. 10 schematically shows a front view and a side view of a section of the cooling mass production device 100 of FIG. 9, this however comprises a heat exchanger device 200 which has a slot 233 for installing the stirring shaft 520 and in which the flow 210 and the return 220 are disposed radially laterally from the heat exchanger plates 230. FIG. 11 schematically shows a partially exploded side view of the cooling mass production device 100 of FIG. 10. The relatively large radial distance between the heat exchanger plates 230 and the container 110 is apparent here, which corresponds at least to the width in the radial direction of the feed 210 or the drain 220. The stirring shaft 520 is coupled in a contactless manner to the stirring motor 530 by way of the magnetic coupling 550. In one embodiment, the stirring shaft 520 can be axially divided into stirring shaft segments. The segments can be joined to form a complete shaft using appropriate couplings, for example magnetic couplings as well.

Figure 12:
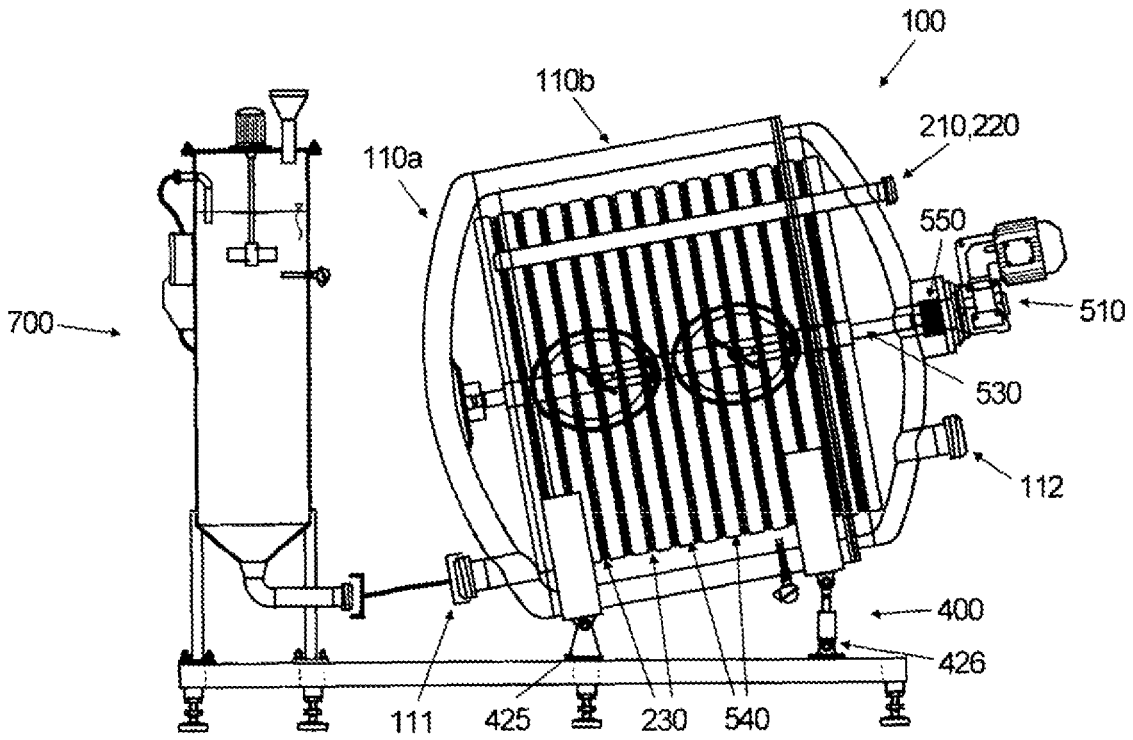
FIG. 12 schematically shows a cross-sectional view of another ice slurry production device.

FIG. 12 schematically shows a cross-sectional view of another cooling mass production device 100. The cooling mass production device 100 is designed larger than in the previous exemplary embodiment and accordingly comprises more heat exchanger plates 230, which additionally have a larger heat exchanger surface, and accordingly more stirring elements 540. The inclination regulating unit 400 comprises a pivot bearing 425, one end of which rotatably mounts the container 110. A linear actuator 426, which is flexibly connected to the container 110, is formed at an axial distance therefrom. The angle of inclination 410 can be adjusted by displacing the linear actuator 426. Since the stirring motor can be arranged freely due to the magnetic coupling and, as a result, the end face is free of through-passages, an inclination is freely selectable since no seals are provided, which, in a slanted position, might experience higher loading from a fluid pressing on the end face.

Figure 13:
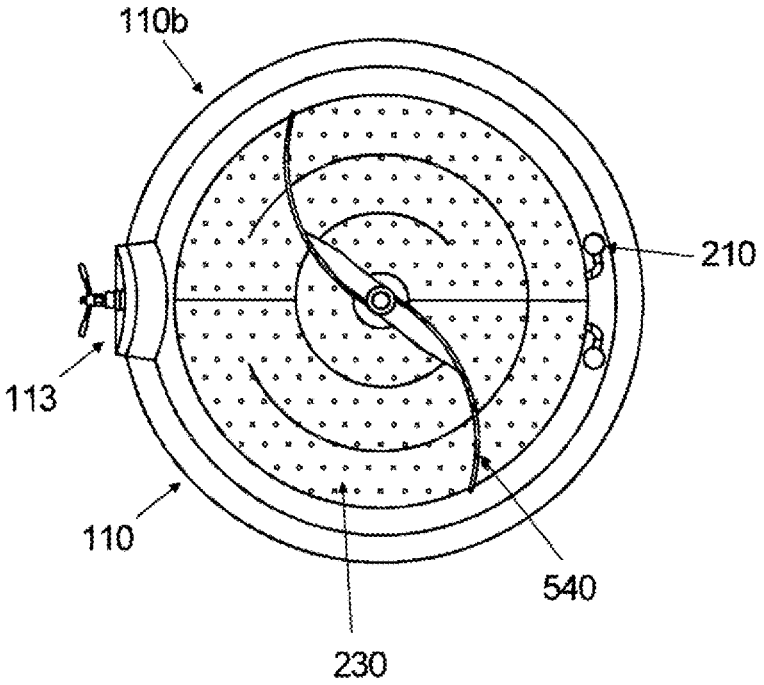
FIG. 13 schematically shows another cross-sectional view of the ice slurry production device.

FIG. 13 schematically shows another cross-sectional view of the cooling mass production device 100. The stirring shaft 520 is disposed in the central through-passage 231 of the heat exchanger plate 230. The feed 210 and the drain 220 are disposed at a radial lateral distance from the heat exchanger plate 230 between the heat exchanger plate 230 and the side wall 110*b* of the container 110. The stirring element 540 extends radially from the stirring shaft 520. The stirring element 540 has a propeller-like or paddle design here. The profile of the stirring element 540 has an S-shaped cross-section. In addition, the stirring element 540 has a changed curvature in the axial direction A, so as to cause additional conveying in a further direction, this being the axial direction. In this way, the conveying device 600 is integrated into the stirring device 500. Conveying thus takes place radially along the heat exchanger surfaces. As a result of the S-shaped curvature and the centrifugal forces, conveying takes place radially outwardly in the direction of the side wall 110*b* of the container 110. In addition, conveying takes place in the axial direction A due to the axial curvature of the stirring element 540. As a result, three-dimensional mixing and/or conveying takes place, which is additionally supported by the slanted position of the axis A or of the housing 110.

Figure 14:
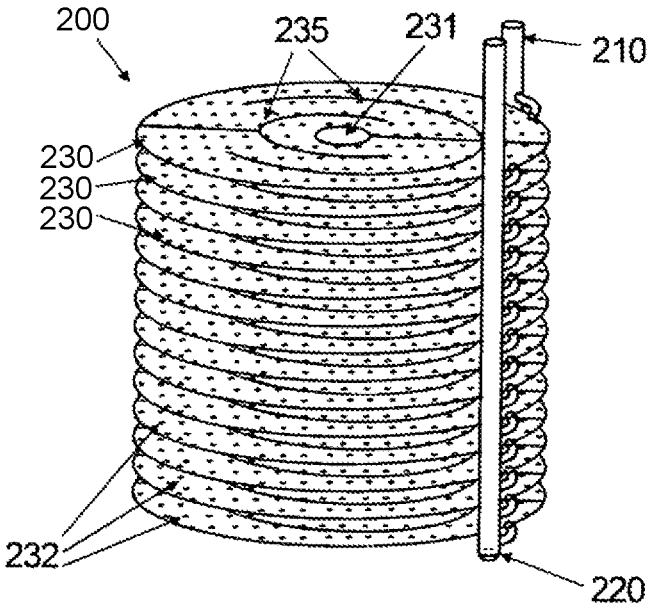
FIG. 14 schematically shows a perspective view of a heat exchanger device of the ice slurry production device of FIG. 13.

FIG. 14 schematically shows a perspective view of the heat exchanger device 200 of the cooling mass production device 100 of FIG. 13. The flow 210 and the return 220 extend radially outside the heat exchanger plates 230. The interior of the heat exchanger plates 230 has a flow field. The flow field has circular arc-like walls as flow guide means 235, which extend from an inner side of the heat exchanger plate 230 to the opposite side. A flow path is thus defined for the refrigerant in the interior space. In addition, protrusions or depressions are provided in the interior space, which cause improved swirling of the refrigerant in the interior space. In this way, more effective heat transmission is achieved.

The device is suitable for a wide variety of application purposes. For example, the device can also be used with substance mixtures that separate in predetermined temperature ranges, for example a gas-liquid mixture into a liquid phase and a gaseous phase. The device is thus used with substance separation in sewage treatment plants, for example.

It goes without saying that a number of additional embodiments exist, although the above abstract and the detailed description of the figures describe only one exemplary embodiment. Rather, the detailed description above will be useful to a person skilled in the art as suitable instructions for implementing at least one exemplary embodiment. The above-described features of the invention can, of course, be used not only in the described combination, but also in other combinations or alone, without departing from the scope of the present invention.

LIST OF REFERENCE NUMERALS

10 base mass (ice slurry brine, sugar water)
20 support base
21 pedestal
100 cooling mass production device
110 housing (container)
110*a* end face
110*b* side wall(s)
111 supply point
112 draw-off point
113 maintenance opening
114 cover
200 heat exchanger device
210 flow/feed
220 return/drain
230 heat exchanger plate
231 through-passage
232 intermediate space
233 slot
234 receptacle
235 flow guide means
400 inclination regulating unit
410 angle of inclination
420 inclination element
421 pedestal
425 pivot bearing
426 linear actuator
500 stirring device
510 stirring drive
520 stirring shaft
530 stirring motor
540 stirring element
550 magnetic coupling
600 conveying device
700 level regulating unit
710 brine container (first)
720 brine container (second)
A axis, axial direction

The invention claimed is:

1. A method for continuously producing a flowable, pumpable, temperature-controlled cooled mass or cooling mass for use as foodstuffs and food products and/or for foodstuffs and food products made of a flowable base mass using a cooling mass production device including a housing, a heat exchanger device, stirring elements and a contactless force transmission unit, the method comprising the following steps:

filling the housing with the flowable base mass;

controlling the temperature of, and thereby cooling, the flowable base mass by bringing it in contact with the heat exchanger device disposed in the housing while stirring, by the stirring elements, the flowable base mass so as to generate the flowable, pumpable, temperature-controlled cooled mass or cooling mass, the flowable base mass and/or the flowable, pumpable, temperature-controlled cooled mass or cooling mass being moved radially outwardly along a surface of the heat exchanger device during stirring by the stirring elements, and a stirring force being transmitted from an outside of the housing to an inside of the housing without contact and without apertures through the housing;

detecting whether a thickness of an ice layer formed on the surface of the heat exchanger device between the heat exchanger device and the stirring elements is less than, equal to, or greater than a predetermined layer thickness defined by a distance between a surface of the ice layer contacting the surface of the heat exchanger device and an opposite surface of the ice layer;

based on the detecting, interrupting the controlling, and thereby cooling, when the thickness of the ice layer formed on the surface of the heat exchanger device between the heat exchanger device and the stirring elements is equal to or greater than the predetermined layer thickness, and based on the detecting, continuing the controlling, and thereby cooling, when the thickness of the ice layer formed on the surface of the heat exchanger device between the heat exchanger device and the stirring elements is less than the predetermined layer thickness, wherein the detecting is accomplished without contact of the stirring elements with the heat exchanger device and/or the ice layer.

2. The method according to claim 1, wherein stirring takes place without contact with the heat exchanger device.

3. The method according to claim 1, wherein the method is carried out in a slanted position.

4. A method according to claim 1, wherein controlling the temperature, and thereby cooling, of the flowable base mass is carried out by controlling the temperature, and thereby cooling, the flowable base mass to a temperature in the range of plus/minus 5 degrees Celsius around the melting point or freezing point of the flowable base mass.

5. A method for providing air conditioning to a room, comprising:

producing a latent energy storage system in which energy is stored in and/or removed from, by continuously producing a flowable, pumpable, temperature-controlled cooled mass or cooling mass using a cooling mass production device including a housing, a heat exchanger device, stirring elements and a contactless force transmission unit, continuously producing the flowable, pumpable, temperature-controlled cooled mass or cooling mass comprising:

filling the housing with the flowable base mass;

controlling the temperature of, and thereby cooling, the flowable base mass by bringing it in contact with the heat exchanger device disposed in the housing while stirring, by the stirring elements, the flowable base mass so as to generate the flowable, pumpable, temperature-controlled cooled mass or cooling mass, the flowable base mass and/or the flowable, pumpable, temperature-controlled cooled mass or cooling mass being moved radially outwardly along a surface of the heat exchanger device during stirring by the stirring elements, and a stirring force being transmitted from an outside of the housing to an inside of the housing without contact and without apertures through the housing;

detecting whether a thickness of an ice layer formed on the surface of the heat exchanger device between the heat exchanger device and the stirring elements is less than, equal to, or greater than a predetermined layer thickness defined by a distance between a surface of the ice layer contacting the surface of the heat exchanger device and an opposite surface of the ice layer;

based on the detecting, interrupting the controlling, and thereby cooling, when the thickness of the ice layer formed on the surface of the heat exchanger device between the heat exchanger device and the stirring elements is equal to or greater than the predetermined layer thickness; and based on the detecting, continuing the controlling, and thereby cooling, when the thickness of the ice layer formed on the surface of the heat exchanger device between the heat exchanger device and the stirring elements is less than the predetermined layer thickness;

wherein the detecting is accomplished without contact of the stirring elements with the heat exchanger device and/or the ice layer; and cooling the room using the latent energy storage system.

6. A method for providing air conditioning to a room, comprising:

producing a heat storage system in which heat is buffered in and/or extracted from, by continuously producing a flowable, pumpable, temperature-controlled cooled mass or cooling mass using a cooling mass production device including a housing, a heat exchanger device, stirring elements and a contactless force transmission unit, continuously producing the flowable, pumpable, temperature-controlled cooled mass or cooling mass comprising:

filling the housing with the flowable base mass;

controlling the temperature of, and thereby cooling, the flowable base mass by bringing it in contact with the heat exchanger device disposed in the housing while stirring, by the stirring elements, the flowable base mass so as to generate the flowable, pumpable, temperature-controlled cooled mass or cooling mass, the flowable base mass and/or the flowable, pumpable, temperature-controlled cooled mass or cooling mass being moved radially outwardly along a surface of the heat exchanger device during stirring by the stirring elements, and a stirring force being transmitted from an outside of the housing to an inside of the housing without contact and without apertures through the housing;

detecting whether a thickness of an ice layer formed on the surface of the heat exchanger device between the heat exchanger device and the stirring elements is less than, equal to, or greater than a predetermined layer thickness defined by a distance between a surface of the ice layer contacting the surface of the heat exchanger device and an opposite surface of the ice layer;

based on the detecting, interrupting the controlling, and thereby cooling, when the thickness of the ice layer formed on the surface of the heat exchanger device between the heat exchanger device and the stirring elements is equal to or greater than the predetermined layer thickness; and based on the detecting, continuing the controlling, and thereby cooling, when the thickness of the ice layer formed on the surface of the heat exchanger device between the heat exchanger device and the stirring elements is less than the predetermined layer thickness;

wherein the detecting is accomplished without contact of the stirring elements with the heat exchanger device and/or the ice layer; and cooling the room using the heat storage system.

* * * * *